United States Patent [19]

Gisiger

[11] 4,324,120

[45] Apr. 13, 1982

[54] PERMUTATION LOCK, PARTICULARLY FOR HANDBAGS AND SUITCASES

[75] Inventor: Urs Gisiger, Selzach, Switzerland

[73] Assignee: Amiet AG, Selzach, Switzerland

[21] Appl. No.: 70,842

[22] Filed: Aug. 29, 1979

[51] Int. Cl.[3] ..... E05B 37/02

[52] U.S. Cl. ..... 70/312; 70/74

[58] Field of Search ..... 70/312, 69–76, 70/320, DIG. 42

[56] References Cited

U.S. PATENT DOCUMENTS 2,144,047 1/1939 Eden ..... 70/312

3,973,419 8/1976 Atkinson ..... 70/312

*Primary Examiner*—Robert L. Wolfe

*Attorney, Agent, or Firm*—Michael J. Striker

[57] ABSTRACT

A permutation lock has at least two lock stopping devices each including an arresting disc provided with an intake recess and cooperating via a multipoint arresting device with a setting disc. A lock adjusting slider biased against the arresting disc is provided at one end with an arresting tongue which is engageable with the intake recesses. The other end of the lock adjusting slider has a projection which so cooperates with the actuation slider that when the arresting tongue disengages the intake opening and the actuation slider is in its closing position, the projection on the arresting slider engages a recess in the actuation slider. If the actuation slider is in an opening position, the projection bears on an abutment portion on the actuation slider and the arresting tongues cannot be displaced from the intake openings.

10 Claims, 23 Drawing Figures

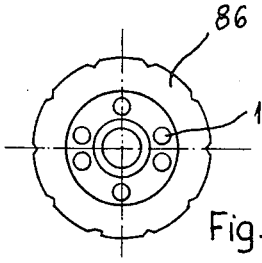
Fig. 14b
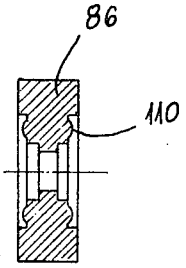
Fig. 14a
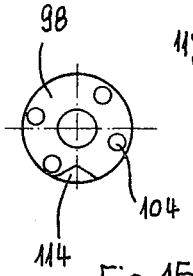
Fig. 15a
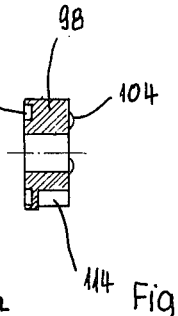
Fig. 15b
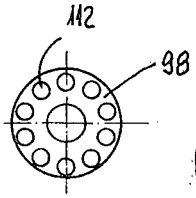
Fig. 15c
Fig. 16
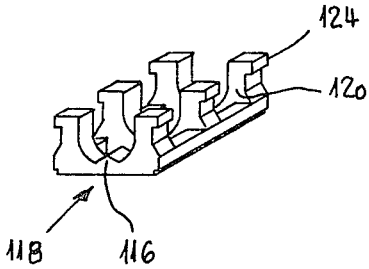
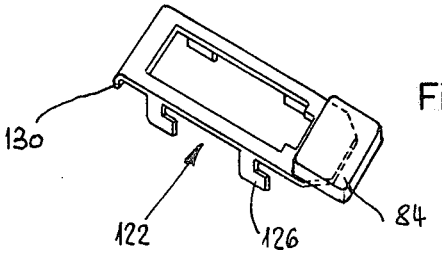
Fig. 17

PERMUTATION LOCK, PARTICULARLY FOR HANDBAGS AND SUITCASES

BACKGROUND OF THE INVENTION

This invention relates generally to permutation locks, and more particularly it relates to a permutation lock of the type which includes at least two lock stopping devices each having an arresting disc provided with an intake recess and cooperating via a multipoing arresting device with a setting disc to adjust the angular position of the latter to the intake recess, an actuation slider movable between a closing position and an opening position, and at least one tumbler slider which is spring-biased into a closing position and cooperates with the actuation slider.

Known permutation locks of this type have the disadvantage in a relatively complicated structure. As a consequence, such known permutation locks have usually a large overall height that makes it necessary to provide the wall of the object to which the permutation lock is to be attached such as, for example a suitcase, with recesses in which a part of the lock housing has to be sunk. In addition, it is frequently required that the permutation locks of this type be accessible from the rear side in order to enable the operation of a coupling member which arrests the arresting discs so that a new code might be adjusted on the setting discs.

SUMMARY OF THE INVENTION

It is, therefore, a general object of the present invention to overcome the aforementioned disadvantages.

More particularly, it is an object of the invention to provide an improved permutation lock arrangement which has a space-saving structure, and which has a flat configuration.

An additional object of the invention is to provide such an improved permutation lock arrangement which does not contain any additional members for arresting the lock-stopping devices.

A further object of the invention is to provide such an improved permutation lock which is simple in structure and easy to manufacture.

In keeping with these objects and others which will become apparent hereafter, one feature of the invention resides, in a permutation lock of the aforedescribed type, in a combination which comprises arresting sliders each being spring-biased against an assigned arresting disc and including at the end facing the arresting disc, an arresting tongue engageable with the intake recess in the arresting disc and at the other end a projection, the actuation slider having openings for receiving the projections of the arresting sliders when the actuation slider is in its closing position and thus allowing disengagement of the arresting tongues from the intake recesses, and further including abutments for stopping the projections when the actuation slider is in its opening position and thus preventing the disengagement of the arresting tongues from the intake recesses. In this manner the arresting discs are blocked and the setting disc can be adjusted to a different position representing a different code.

On the other hand, when the actuation slider is in its closing position, the arresting sliders are movable away from the arresting discs inasmuch as the projections of the arresting sliders can enter the openings in the actuation slider and by rotating the setting disc the arresting tongues are displaced from the intake recesses in the arresting disc. As a result, the actuation slider is arrested in its closing position and cannot be opened. By virtue of this novel combination in the permutation lock of this invention, an additional actuation member for arresting the lock stopping devices can be dispensed with and consequently a particularly simple construction of the permutation lock will result which makes it also possible to provide a permutation lock which has a very flat configuration. This flat structure in turn makes necessary any mounted recesses in the walls of the object to which the lock is to be applied. The permutation lock of this invention thus can be mounted on very flat objects such as, for example, handbags.

In a preferred embodiment, the arresting tongue forms an integral part of the assigned arresting slider. In a modification, a plurality of arresting tongues can be provided on a common arresting slider. The latter arrangement of all arresting tongues on a single common arresting slider makes an unauthorized opening of the lock more difficult because the detection of the right position of the arresting discs by touch or accoustically is prevented.

A particularly simple construction of the permutation lock of this invention is attained when the arresting slider and the actuation slider are movable transversely to each other in two different planes, whereby the actuation member has a bent portion provided with the openings and with the abutment parts.

In another preferred embodiment of this invention, the arresting tongues have a tapering shape whereby the intake recess in the arresting disc has a corresponding wedge-shaped configuration.

In an advantageous modification of this invention, the arresting slider is provided with an axial slot for receiving a helical biasing spring which seats in a recess in the lock body and contacts the end facing the arresting disc.

The tumbler slider with the latch nose is movably supported in the lock body and is spring-biased into its locking position and is coupled in the opening direction to the actuation slider. The tumbler slider or the actuation slider are provided with an elongated slot in which a carrier nose on one of these sliders is engageable. In this manner it is possible that the locking member of a locking hasp or hinge can be engaged also in the case when the code of the permutation lock does not correspond to an opening position. This arrangement has the advantage that the setting discs can be misadjusted immediately upon the opening of the lock so that the code of the permutation lock remains hidden to an unauthorized person.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 14*a* is a sectional side view of a setting disc;

FIG. 14*b* is a top view of the setting disc of FIG. 14*a;*

FIG. 15*a* is a bottom view of an arresting disc;

FIG. 15*b* is a sectional side view of the arresting disc of FIG. 15*a;*

FIG. 15*c* is a top view of the arresting disc of FIG. 15*a;*

FIG. 16 is a perspective top view of an arresting slider with arresting tongues; and FIG. 17 is a perspective top view of an actuation slider.

DESCRIPTION OF THE PREFERRED EMBODIMENTS

Figure 1:
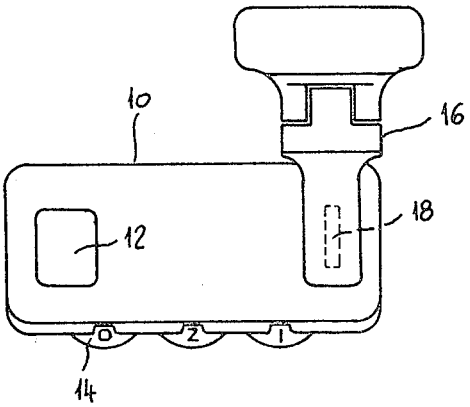
FIG. 1 is a top view of a permutation lock assembly of this invention.
Figure 5:
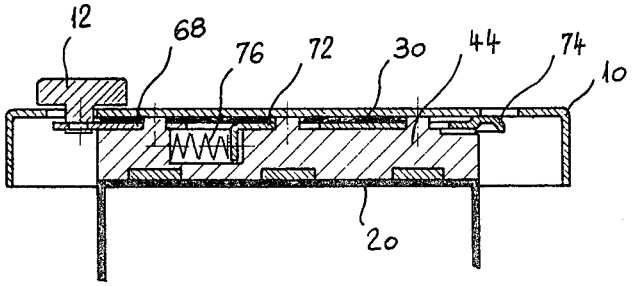
FIG. 5 is a sectional front view of the permutation lock of FIG. 2 taken on line V—V.
Figure 6:
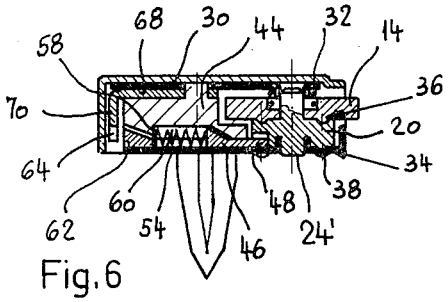
FIG. 6 is a sectional side view of the permutation lock of FIG. 2 taken along the line VI—VI.
Figure 7A:
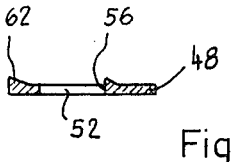
FIG. 7*a* is a longitudinal section of an arresting slider.
Figure 7B:
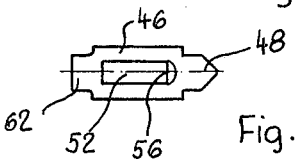
FIG. 7*b* is a top view of the arresting slider of FIG. 7*a;*

FIG. 1 illustrates an overall top view of the permutation lock assembly which includes a lock housing 10 through the top of which projects an actuation knob 12 and through one side wall of which project three setting discs 14 arranged parallel to the top wall of the lock and each being rotatable to adjust a code from 0 to 9. The top wall of the lock housing 10 is further provided with an opening for receiving a locking staple or member 18 of a lock hasp or hinge 16.

Referring now to FIGS. 2–9, the permutation lock unit in the illustrated embodiment includes three lock stopping devices each having one of the aforementioned setting discs 14 and an arresting disc 20. As seen from FIG. 8, the bottom side of the arresting disc 20 is formed with a central pin 24 surrounded by an annular recess 22 which engages a tubular support 24′ in the bottom plate 26 of the housing 10. Opposite the central pin 24 the arresting disc 20 is formed with a stub shaft 28 on which the setting disc 14 is supported for rotation. As seen from FIG. 6, a spiral spring 32 is arranged between the cover plate 30 of the lock housing 10 and the setting disc 14 and biases the latter downwardly against the arresting disc 20 and thus urges disc 20 against the bottom plate 26.

Figure 3:
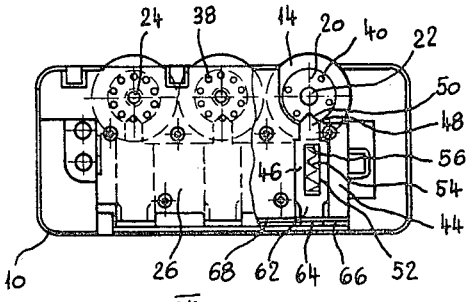
FIG. 3 is a bottom view of the permutation lock of FIG. 2 with a partly cut-away bottom plate.
Figure 8A:
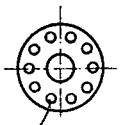
FIG. 8*a* is a top view of an arresting disc.
Figure 8B:
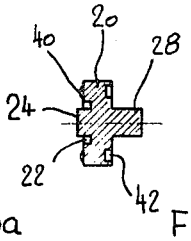
FIG. 8*b* is a sectional side view of the arresting disc of FIG. 8*a;*
Figure 8C:
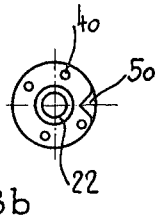
FIG. 8*c* is a bottom view of the arresting disc of FIG. 8*a;*
Figure 9:
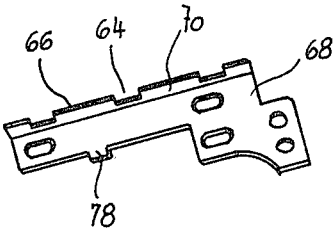
FIG. 9 is a perspective bottom view of an actuation slider.
Figure 12:
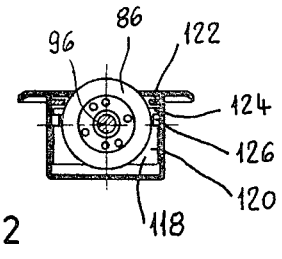
FIG. 12 is a sectional side view of the permutation lock of FIG. 11 taken along the line XII—XII.

A first multipoint arresting device 34 is provided between each arresting disc 20 and the bottom plate 26 and a second multipoint arresting device 36 is provided between the setting disc 14 and the arresting disc 20. The first multipoint arresting device 34 is formed by a plurality of recesses 38 in the bottom plate 26 corresponding in number to the employed code characters and cooperating with a corresponding number of cams or protuberances 40 on the lower side of the assigned arresting disc 20 (FIGS. 3 and 8). Similarly, the upper side of each arresting disc 20 is shaped with a plurality of recesses 42 corresponding in number to the number of selectable code characters and being engageable with a corresponding number of cams in the facing surface of the setting disc 14. The first multipoint arresting device 34 serves for arresting the setting disc 14 together with the arresting disc 20 and the second multipoint arresting device 36 serves for an arrestable angular displacement of the setting disc 14 relative to the arresting disc 20. In order to prevent an unintentional change of the code during the adjustment of the setting disc, the latter is provided with a larger number of arresting cams than that of the arresting disc 20. Arresting sliders 46 supported for a sliding movement on the lower side of the lock body 44 cooperate with each arresting disc 20. The arresting slider 46 has an arresting tongue 48 having a wedge-like configuration and being engageable with a correspondingly shaped intake recess 50 in the periphery of the arresting disc 20 as seen particularly from FIGS. 3, 6 and 8. An elongated slot 52 is formed in the body of the arresting slider 46 and serves for receiving a spiral spring 54 which biases the arresting slider 46 against the periphery of the arresting disc 20. The biasing spiral spring 54 engages end portion 56 of the longitudinal slot 52 and its other end 58 sits in a recess 60 in the lock body 44. The end of the arresting slider 46 opposite the arresting tongue 48 is provided with a projection 62 which is shaped to engage an opening 64 or to abut against a stop portion 66 of the actuation slider 68.

Figure 2:
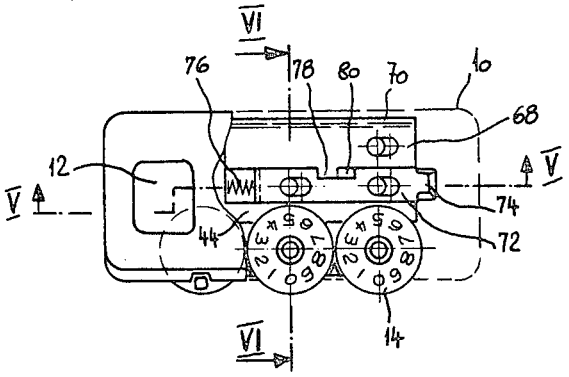
FIG. 2 is a top view of a permutation lock of FIG. 1 with a partly cut-away housing.
Figure 4:
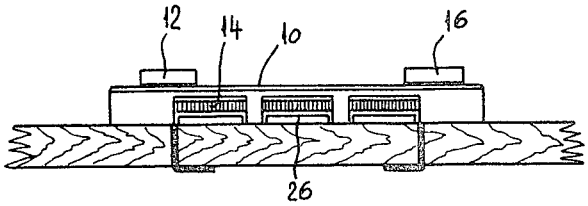
FIG. 4 is a front view of the permutation lock assembly of FIG. 1.

The actuation slider 68 is slidably supported on the upper side of the lock body 44 and is movable at right angles to the direction of movement of the arresting slider 46. The actuation slider 68 has an angular portion 70 facing the projection 62 of the arresting slider 46 and being provided with the aforementioned openings 64 and stop surfaces 66 for controlling the movement of the projection 62. The actuation slider 68 is connected to the actuation knob 12 which projects through an opening in the top plate of the lock housing 10. The actuation slider 68 cooperates with a tumbler slider 72, the latter having a projecting latch nose 74 which is engageable with a locking part or staple 18 of the lock hinge 16. The tumbler slider is biased in the closing direction by means of a spiral spring 76. The coupling between the actuation slider 68 and the tumbler slider 72 is established by means of a coupling member which includes a carrier nose 78 formed on the longitudinal edge of the actuation slider 68 and an elongated slot 80 in the tumbler slider 72. The slot 80 is positioned so that at least in the spring-biased closing position of the tumbler slider 72, the trailing edge of the elongated slot 80 engages the carrier nose 78 of the actuation slider 68. This arrangement permits the latch nose 74 of the tumbler 72 to engage the locking staple 18 even in the locking or closing position of the actuation slider 68 as illustrated in FIG. 2. In this manner the permutation lock of this invention enables the locking of the lock staple 18 of the lock hasp 16 even in the case when the setting discs are not adjusted to the opening code.

The operation of the above-described embodiment of the permutation lock of this invention is as follows To open the permutation lock, the setting discs 14 have to be rotated to a position in which a predetermined code for the opening appears on the visible parts of the setting discs. In the example of FIG. 1, this opening code is, for instance, 0-2-1. In this open position the intake recesses 50 in respective arresting disc 20 face the arresting tongues 48 of respective arresting sliders 46 and the biasing springs 54 bring the tongues 48 into engagement with the recesses 50. As a result, the projections 62 on the other end of arresting sliders 46 disengage the openings 64 in the actuation slider 68 and thus unblock the movement of this actuation slider so that the latter can now be displaced by the actuation knob 12 into its opening position. In doing so, the carrier nose 78 of the actuation member 68 moves along the tumbler slider 72 against the force of the spring 76 and the latch nose 74 disengages the locking staple 18 and the lock hinge 16 can be opened. By releasing the actuation knob 12 the biasing spring 76 displaces via the tumbler slider 72 the actuation slider 68 into its closing position in which the adjusted code on the setting disc 14 can be cancelled so that the right code for opening the lock is no longer visible. Nonetheless, the engagement of the locking staple 18 with the latch nose 74 and thus the locking of the lock hinge 16 is still possible as it has been explained above.

For setting a new opening code it is necessary first to reset the old opening code and setting discs 14 and to bring the actuation slider 68 into its opening position in which its abutment parts 66 are moved into the path of movement of the projection 62 of the arresting slider 46 so that the latter cannot disengage the intake recesses in the arresting discs 20 when the setting discs 14 are manipulated. In this manner, during the rotation of the setting discs 14 the arresting discs 20 remain blocked and a new code can be set in a very simple manner.

Figure 10:
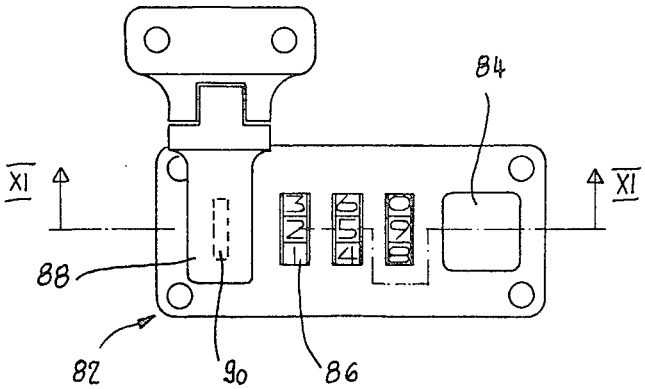
FIG. 10 is a top view of a modification of a permutation lock assembly of this invention.

FIG. 10 shows in an overall view a modified version of the permutation lock of this invention having a lock housing 82, an actuation knob 84 projecting from the upper plate of the housing and three setting discs 86 arranged in windows in the upper plate and each carrying code numerals from 0 to 9. The setting discs 86 are arranged at right angles to the major surface of the permutation lock. Similarly, as in the preceding example, a lock hasp or hinge 88 is provided with a locking staple 90 which is engageable into an opening in the top plate of the housing 82.

The details of the permutation lock of FIG. 10 will now be explained with reference to FIGS. 11–17.

The lock includes three lock stopping devices arranged, respectively, in the housing 82 in three chambers 94 separated by partitions 92. A common axle 96 supports all three lock stopping devices in their chambers 94. Each lock stopping device is assembled of an arresting disc 98 and a setting disc 96, and of a spring 100 which urges the two discs against the transverse partition 92. The first multipoint arresting device 102 is arranged between the arresting disc 98 and the partition 92 and serves for holding the setting disc 86 in a selected position. The first arresting device 102 is constituted by a plurality of bosses or cams 104 which engage corresponding recesses 106 in the partition 92. There are as many recesses 106 as many positions or code numerals are adjustable by the setting disc 86. A second multipoint arresting device 108 is disposed between the arresting disc 98 and the setting disc 86 and is constructed similarly as the first arresting device 102, that means the setting disc 86 is provided with bosses or cams 110 which engage recesses 112 formed in the arresting disc 98. The arresting disc contains again as many recesses 112 as many positions or code numbers are available. The recesses and cams of respective multipoint arresting devices are distributed along a circular section centered on the axis of rotation of the discs. The number of bosses or cams 110 on the setting disc 86 is larger than the number of cams 104 on the arresting disc 28 and consequently the second multipoint arresting device 108 has a larger resistance against rotation than the first multipoint arresting device 102. The first arresting device 102 serves for releasably holding the angular position of the arresting disc 98, the second multipoint arresting device 108 serves for setting the opening code on the setting discs.

Figure 13:
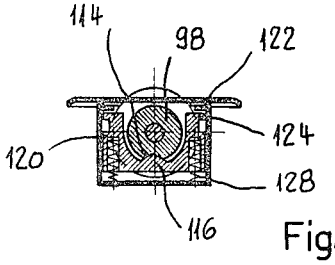
FIG. 13 is a sectional side view of the permutation lock of FIG. 11 taken along the line XIII—XIII.
Figure 11:
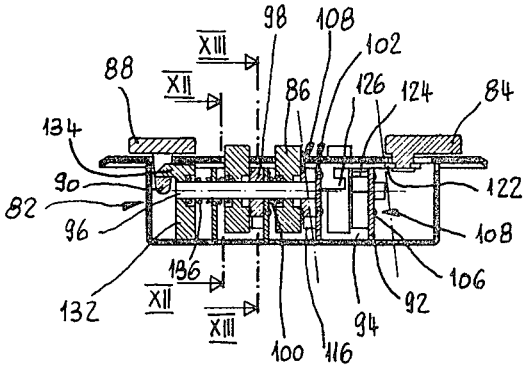
FIG. 11 is a sectional front view of the permutation lock of FIG. 10 taken along the line XI—XI.

Each arresting disc 98 is provided on its periphery with an intake recess 114 for receiving an arresting tongue 116 which is provided on an arresting slider 118 as seen in FIGS. 11, 13 and 16. In this example, a single arresting slider 118 has as many arresting tongues 116 as many lock stopping devices are employed. In addition, the arresting slider supports three pairs of arms 120 assigned for each lock stopping device. Since the arresting slider 118 is arranged for movement on the lower side of the lock housing 82 and the actuation slider 122 is arranged at the upper side of the lock housing, the arms 120 are situated on both sides of the arresting discs 98 opposite the actuation slider 122. The arms 120 are shaped with outwardly projecting attachments 124 engaging in the open position of the actuation slider 122 with hook-shaped abutments 126 on the latter slider. Spiral springs 128 bias the arresting slider 118 together with the arresting tongues 116 against the arresting discs 98.

As mentioned above, the actuation slider 122 is arranged at the upper side of the lock housing 182 and slidably supported for movement in its longitudinal direction as seen particularly in FIGS. 11 and 17. The actuation slider 122 is connected to the actuation knob 84 and on its opposite end is provided with a carrying nose 130 which cooperates with a tumbler slider 132. The tumbler slider has a latch nose 134 which is engageable with a lock part 90 of a lock hasp or hinge 88. A spring 136 biases the tumbler slider 132 into its closing position. This arrangement makes it possible that in the closing position of the actuation slider 122 the locking staple 19 of the lock hasp or lock hinge 88 can be compressed against the latch nose of the tumbler slider 132 and displaces the latter against its biasing spring whereupon the latch nose lockingly engages the lock staple 90 without the necessity of adjusting the opening code of the lock into its right position.

The function of this embodiment of the permutation lock is smaller to that of the permutation lock of FIGS. 1–9.

If the actuation slider 122 is in its closing position as illustrated in FIG. 11, the hook-shaped stops 126 disengage the attachments 124 of the arresting slider 118 and the latter can slide downwardly against the force of the spiral spring 128. Consequently, the setting disc 86 together with the arresting disc 98 are free to rotate whereby the arresting tongues 116 are expelled from the intake recesses 114. The hook-shaped stops 126 rest on the attachments 124 thus preventing the movement of the actuation slider 122 into its opening position. Upon setting of the opening code of the permutation lock on the setting discs the arresting tongues 116 reengage the intake recesses 114 and the arresting slider 118 is in a position in which the attachments 124 give way to the hook-shaped stop 126 and thus release the movement of the actuation slider 122. The arresting slider 118 can be moved into its opening position whereby the hook-shaped stops 126 are displaced below the attachments 124 of the arresting slider and the latter becomes arrested in this position. At the same time the arresting discs 98 become also arrested by arresting tongues 116 reengaging the intake recesses 114. It is now possible to set a new opening code on the setting discs 86 by overcoming the arresting force of the second multipoint arresting device while rotating the setting disc 86 relative to the arresting discs 98. Upon the release of the actuation slider 122 the blocking of the arresting disc is released and upon overcoming the arresting force of the first multipoint arresting device the setting disc 86 can be rotated only together with the arresting discs 98.

It will be understood that each of the elements described above, or two or more together, may also find a useful application in other types of constructions, differing from the types described above.

While the invention has been illustrated and described as embodied in a permutation lock arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arrangement of a permutation lock, particularly for use in connection with handbags and suitcases, including at least two lock stopping devices each having an arresting disc provided with an intake recess cooperating via multipoint arresting devices with a setting disc to adjust the angular position of the latter relative to the intake recess, an actuation slider movable between a closing position and an opening position, and at least one tumbler slider spring-biased into a closing position and cooperating with the actuation slider, a combination comprising at least one arresting slider spring-biased against said arresting disc and including arresting tongues engageable with said intake recesses and a projection formed opposite to said arresting tongues; said actuation slider having openings for receiving said projection when said actuation slider is in its closing position and thus allowing disengagement of said arresting tongues from said intake recesses; and abutments arranged on said actuation slider for stopping said projection when said actuation slider is in its opening position and thus preventing the disengagement of said arresting tongues from said intake recesses and permitting the angular displacement of said setting discs relative to said arresting discs.

2. The combination as defined in claim 1, comprising as many arresting sliders with arresting tongues as many lock stopping devices take place.

3. The combination as defined in claim 1, comprising a single arresting slider shaped with as many arresting tongues as many lock stopping devices take place.

4. The combination as defined in claim 1, wherein said arresting slider and said actuation slider are arranged in two different planes for sliding movement at right angles one to another, said actuation slider having an angular portion facing said arresting slider, said angular portion being provided with said openings and abutments cooperating with said projection on said arresting slider.

5. The combination as defined in claim 1, wherein each arresting tongue and each intake opening has, respectively, a wedge-like shape.

6. The combination as defined in claim 1, wherein said arresting slider is provided with a longitudinal slot, a biasing spring disposed in said slot and arresting at one end in a recess in the lock body and at the other end on said arresting slider.

7. The combination as defined in claim 1, wherein said tumbler slider includes a latch nose and unidirectional coupling means for coupling said tumbler slider to said actuation slider in the opening direction only.

8. The combination as defined in claim 7, wherein said unidirectional coupling means includes a longitudinal slot provided in one of said sliders and a carrier nose provided on the other slider and engaging said slot.

9. The combination as defined in claim 1, including at least two lock stopping devices each having arresting and setting discs supported for rotation about axes extending in alignment with the direction of movement of the actuation slider, said arresting slider being arranged at the side of said arresting discs facing said actuation slider and being spring biased transversely to the axis of said arresting disc, said arresting slider further supporting at least a pair of arms arranged at both sides of the arresting discs opposite the actuation slider and being provided at their ends with attachments, and said actuation slider being provided with hook-shaped stops for engaging in the open position of the actuation slider said attachments.

10. The combinations as defined in claim 9, wherein said arresting slider is provided with as many pairs of said arms as many arresting discs take place.

* * * * *